United States Patent [19]

Sauthier et al.

[11] 4,030,283

[45] June 21, 1977

[54] ELECTRICALLY DRIVEN TIME PIECE WITH MEANS FOR EFFECTING A PRECISE SETTING OF TIME

[75] Inventors: Pierre A. Sauthier, Bruegg; Cyril Vuilleumier, Bienne, both of Switzerland

[73] Assignee: Societe Suisse Pour l'Industrie Horlogere Management Services S.A., Bienne, Switzerland

[22] Filed: Mar. 24, 1975

[21] Appl. No.: 561,344

[30] Foreign Application Priority Data

Mar. 25, 1974 United Kingdom ..... 13090/74

[52] U.S. Cl. ..... 58/23 R; 58/85.5

[51] Int. Cl.[2] ..... G04C 3/00

[58] Field of Search ..... 58/85.5, 23 R, 35–36 W

[56] References Cited

UNITED STATES PATENTS

| | | | |
|---|---|---|---|
| 3,282,043 | 11/1966 | Daris | 58/34 X |
| 3,469,390 | 9/1969 | Zimmer | 58/34 |
| 3,530,663 | 9/1970 | Marti | 58/35 R X |
| 3,707,071 | 12/1972 | Walton | 58/50 R |
| 3,733,810 | 5/1973 | Girard | 58/85.5 X |
| 3,810,356 | 5/1974 | Fujita | 58/23 R |
| 3,852,950 | 12/1974 | Yoda et al. | 58/85.5 X |

*Primary Examiner*—Ulysses Weldon
*Attorney, Agent, or Firm*—Griffin, Branigan and Butler

[57] ABSTRACT

An electrically driven timepiece is provided with a single user-actuated push button for controlling a modulo-three counter, the counter being utilized to control display advancing pulses derived from an oscillator and frequency divider. In a first state, the counter controls the display advancing pulses to advance the display at a normal rate. In a second state, the counter controls the display advancing pulses to advance the display at a rapid rate to effect a time correction. In a third state, the counter blocks all advancing pulses whereby the display remains constant. This enables the user to restart the advancement of the display at a precise desired instant. In an alternative embodiment, means are provided within the timepiece for automatically advancing the counter from the second to the third state when the display is advanced to a reference position such as the zero seconds position.

10 Claims, 6 Drawing Figures motor
f0
:2n
FF1
FF2
FF3
FF4
+V

ELECTRICALLY DRIVEN TIME PIECE WITH MEANS FOR EFFECTING A PRECISE SETTING OF TIME

The present invention concerns an electrically driven timepiece and in particular a timepiece provided with a highly accurate time standard, such as for example a quartz controlled oscillator.

Such timepieces have been widely publicized in recent years, particularly in view of their extraordinary precision which may run to an accumulated error of 1 minute or less per year. Where such timepieces are provided with a seconds indication either in the form of a seconds hand or an electro-optic digital seconds indication it is noted that users are irritated should the timepiece show even the slightest inaccuracy when compared for example with broadcast time signals. For this reason various means have been proposed for effecting seconds correction, particularly when the time is being reset for one reason or another.

It has already been proposed in timepieces provided with high frequency time standards and divider circuits to effect time setting electrically by switching a higher than normal frequency signal from the divider chain to the display arrangement. Thus for example a quartz oscillator normally having an output frequency of 32 768 Hz might have this frequency reduced to 1 Hz through a chain of dividers and the 1 Hz output of the final divider stage would then control the advance of the seconds display. If instead of utilizing the 1 Hz output, a higher frequency of, say 32 Hz, was employed it is clearly evident that time setting in respect at least of seconds and minutes could be considerably accelerated, since, in fact, the minutes display would be advanced by approximately one minute in every two seconds.

The problem of such an arrangement arises when it is desired to set the seconds display exactly in conformity with a standard time signal. As can be easily realized, with the seconds display advancing at such a rapid rate, it will be difficult for the user to stop the display at exactly the desired moment, particularly where seconds time signals may be forthcoming at 10 second intervals. It is therefore desirable to provide means by which the user, after having set the time display approximately, may then stop the display, wait for the next time signal and upon receipt of said time restart the display.

The invention accordingly provides an electrically driven timepiece wherein setting of the time display is accomplished through logic circuitry which enables changes to the information displayed to proceed more rapidly than normal and including an externally actuable switch associated with a ring counter which is arranged and adapted so as successively to switch the display to a more rapid drive rate, to stop the display and to return the display to a normal drive rate upon successive actuations of the switch.

Figures 1, 1A, 1B, 1C:
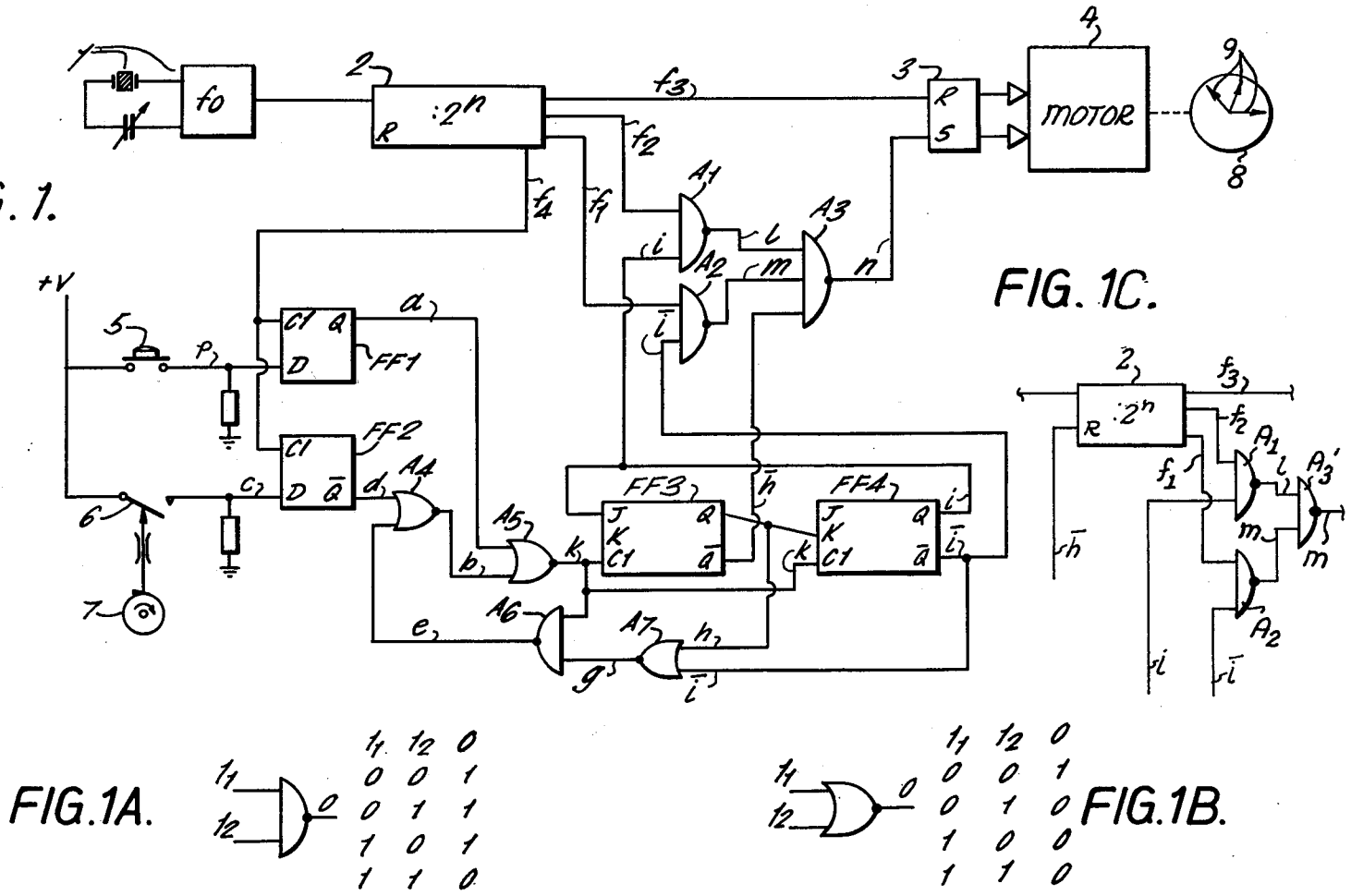

For a better understanding of the invention reference will now be had to the drawings in which FIG. 1 is an illustration of the basic logic circuit of the invention FIG. 1A illustrates a NAND-gate along with its associated truth-table FIG. 1B illustrates a NOR-gate with its associated truth-table FIG. 1C illustrates a modification of the basic logic circuit of FIG. 1.

Figure 2:
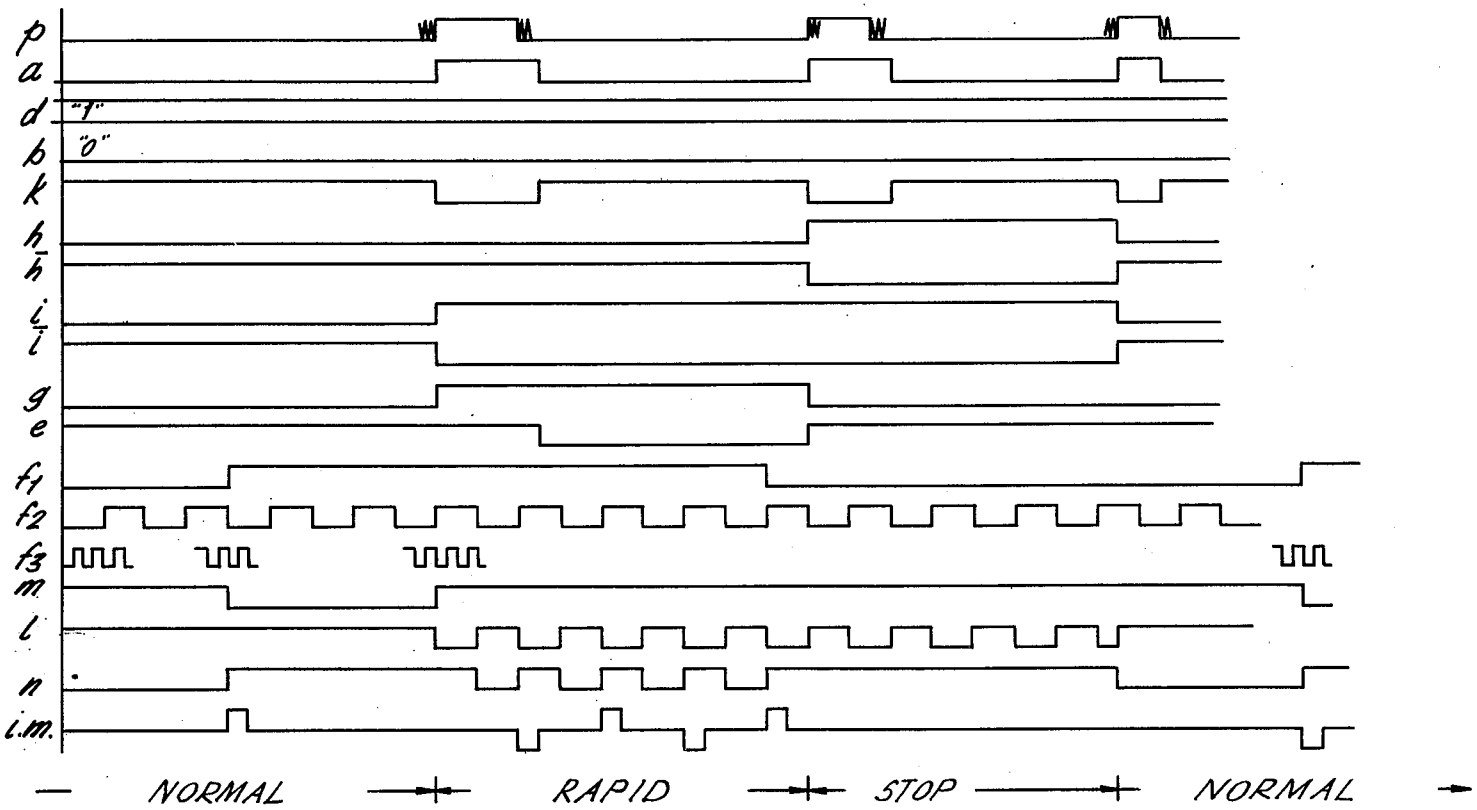
Figure 3:
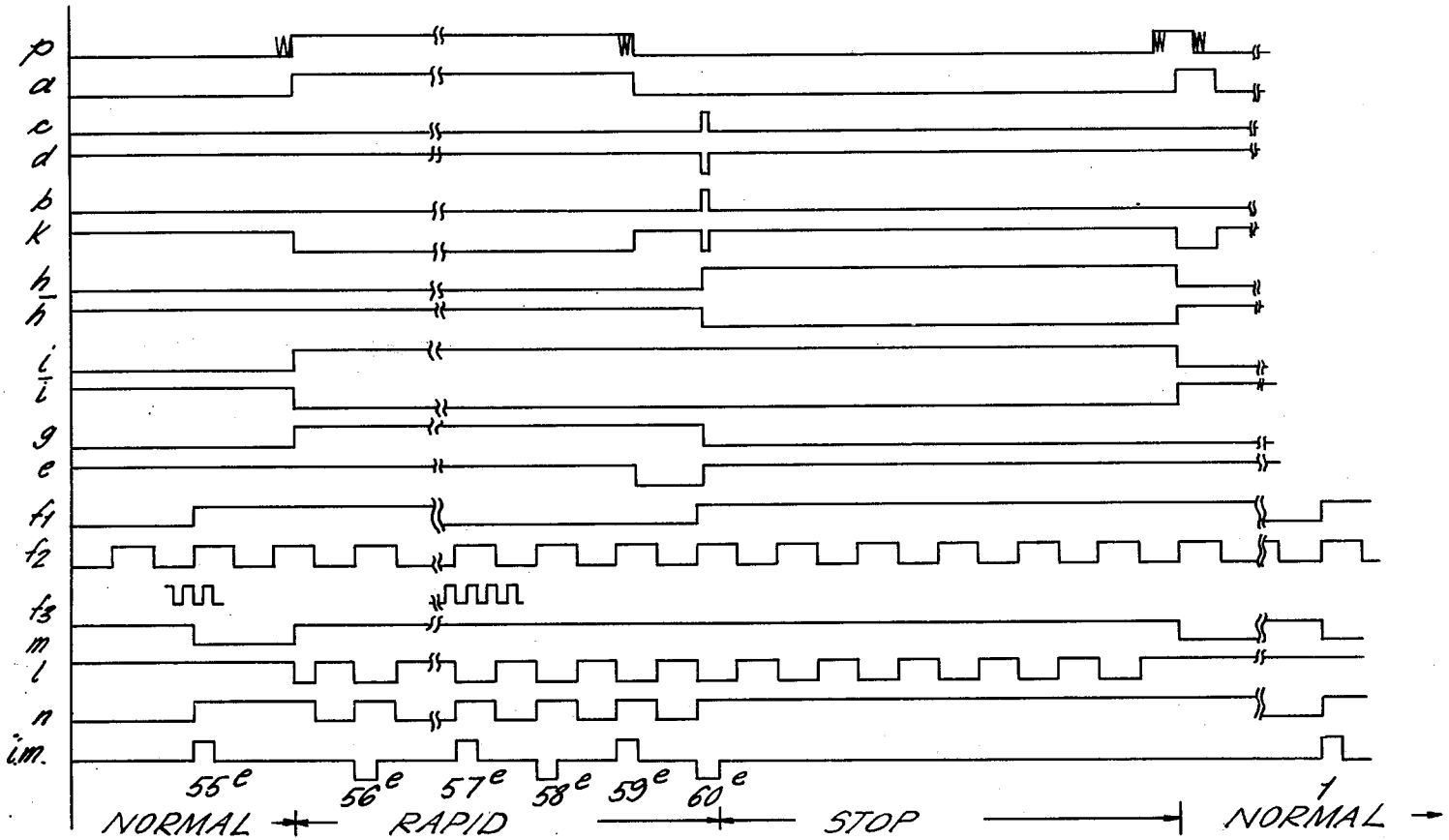

FIG. 2 is a timing diagram showing the operation of a simplified version of the invention in which an internal micro-switch is not utilized and FIG. 3 is a timing diagram showing the operation utilizing all the elements of FIG. 1.

The upper portion of FIG. 1 shows a typical timepiece driving circuit including a crystal controlled oscillator 1, the frequency of which is reduced by means of a frequency divider 2. From the frequency divider various outputs are obtained, certain of which are eventually used to actuate a display means including a motor control unit 3, and in the version illustrated, a motor 4, which may be coupled through a conventional mechanism 8 to drive time indicating hands 9.

It should be clearly realized that although in the illustrated version a motor has been shown, nevertheless the invention is equally applicable to a timepiece utilizing an electro-optical type of display, either of the analogue or of the digital type. In such instance the motor 4 along with its control circuits would be replaced by storage registers and decoders.

It will be noted that output lines labeled $f_1$, $f_2$ in the drawing pass through a portion of the time setting control circuit on their way to the motor control unit 3. The standard output which has been designated to $f_1$, may normally be at a frequency of 1 Hz and is passed via NAND-gates $A_2$ and $A_3$ to the motor control unit 3. Thus, in accordance, with the truth-table shown in FIG. 1A it is obvious that both these gates must have enabling high level 1-inputs in order to pass the signal $f_1$. It follows that under normal operating conditions of the timepiece bistable flip-flops $FF_3$ and $FF_4$ will be in their cleared conditions so that a high level 1-output i is applied from flip-flop $FF_4$ to NAND-gate $A_2$ whereas a low level O-output i is applied to NAND-gate $A_1$ from bistable flip-flop $FF_4$. It is equally clear that a high level 1-output h is applied to NAND-gate $A_3$ from $FF_3$. In view of the low level high input to NAND-gate $A_1$, its output level will be maintained at the high level 1, whereby the output signal $f_1$ is inverted twice on its way to the control unit 3. It will be noted that the signal $f_3$ which may for example be at a frequency of 128 Hz is used to reset the control unit 3, thereby reducing the output pulse width and thereby the power consumption.

In a simplified embodiment of the invention, switch 6 is omitted and no connection is provided to the D input of bistable device $FF_2$ which will at all times remain cleared whereby the output signal on Line d will remain at a high level 1. FIG. 2 illustrates the waveforms occuring on various leads in this embodiment, the waveforms of FIG. 2 being designated by the same reference characters as the lead shown in FIG. 1.

Consider now the sequence of events which follows actuation of push-button 5, which for example in the case of a watch might be incorporated into the crown, although other arrangements are certainly possible. Upon being actuated push-button 5 applies a high level signal to bistable device $FF_1$. This high level signal results in the output labeled *a* going high as long as push-button 5 is actuated.

In view of what has already been said regarding flip-flop $FF_2$, the output from NOR-gate $A_4$ will be a low level 0. Until the moment at which flip-flop $FF_1$ has been set by actuation of push-button 5, the output on line k from NOR-gate $A_5$ will have been at a high level 1. Upon setting of flip-flop $FF_1$ this changes to low level 0. Flip-flops $FF_3$ and $FF_4$ are of a type known in the art as JK flip-flops and are connected so as to form a cycle of three binary ring counter. Such arrangements are well-known to the prior art and in this respect reference may be had to the NV Philips publication "Electronic Applications," volume 28, No. 3, page 104. Thus the first application of a low level signal on the line k changes the state of flip-flop $FF_4$ while leaving flip-flop $FF_3$ in its original state. FIG. 2 illustrates this and shows more specifically that following the change of state of flip-flop $FF_4$ NAND-gate $A_2$ is blocked, NAND-gate $A_1$ is enabled and NAND-gate $A_3$ remains enabled. Thus in place of pulse train $f_1$, pulse train $f_2$ which may for example be at a frequency of 32 Hz, passes to the control unit 3, being inverted twice at $A_1$ and $A_3$ prior to its arrival. The display therefore will be advanced 32 times more quickly than under normal operation.

Should push-button 5 now be actuated a second time the same sequence of events will follow except that the second low level signal appearing on line k now has the effect that $FF_3$ changes state whereby output h now is at a low level 0 whereby NAND-gate $A_3$ is blocked. With NAND-gate $A_3$ thus blocked neither of the pulse sequences $f_1$ or $f_2$ can pass therethrough hence the further advance of the display is stopped.

A slightly different embodiment is illustrated in FIG. 1c wherein the lead $\bar{h}$ is connected to a reset input on the frequency divider 2 rather than to aninput of NAND-gate $A_3$. The effect is that blocking is accomplished at a reset input to the frequency divider rather than at NAND-gate $A_3$ whereby a subsequent restarting operation will ensure that the display is restarted exactly one second following application of a restart signal. Should such a version be used then NAND-gate $A_3$ may be replaced by a two input NAND-gate $A_3$. Otherwise, the circuit of FIG. 1c operates in the same manner as the circuit of FIG. 1.

The user has thus effectively advanced the display of the timepiece to a desired point and has stopped the display whilst awaiting receipt of the standard time signal. Upon receipt of such standard time signal push-button 5 is once again actuated and once again a low going signal will appear on line k. The result of this is to restore flip-flops $FF_3$ and $FF_4$ to their original states as shown in FIG. 2 whereby initial conditions will once again be established and the display will receive the signal $f_1$.

Through addition of a micro-switch 6 a more sophisticated version of the invention may be obtained and this will now be described with reference to FIGS. 1 and 3.

Micro-switch 6 may, in the case of an electromechanical motor driven display, be associated with the seconds axle. Such axle may be provided with a cam 7 which rotates normally once each minute. At a point on the cam, for instance corresponding to the 0-position of the seconds hand, the cam is adapted to actuate the micro-switch 6. Should an electro-optic type of display be utilized the cam and micro-switch 6 would be replaced by detecting means associated with the seconds display register which would produce a suitable signal whenever the register was returned to 0 for example. Should either of these correcting arrangements be desired for timepieces which do not display seconds, it is quite obvious that precisely the same principles may be applied for the setting of a minutes display or for that matter an hours display.

The functioning of the invention utilizing the auxiliary switch 6 is as follows. When push-button 5 is actuated by the user precisely the same sequence of events follows as described with reference to FIG. 1. That is to say, flip-flop $FF_4$ changes state while flip-flop $FF_3$ remains in its initial state. Thus the high frequency pulse train $f_2$ is used to advance the display rapidly.

The advance of the display will in this second instance equally affect the cam 7 or alternately a display register in the event of an electro-optic type of display. The rotation of the cam, as shown, eventually closes switch 6 and applies setting signal c to flip-flop $FF_2$. The normally high output $\bar{Q}$ is replaced by a low going output on line d. At this point it will be realized that output $\bar{i}$ and $h$ are both low, whereby the output from NOR-gate $A_7$ on line g will be high. Since at this time the signal on line $k$ is likewise high the result is that output signal e from NAND-gate $A_6$ is low. The effect of this is, upon the change of state of flip-flop $FF_2$ brought about by micro-switch 6, to send a high going signal to NOR-gate $A_5$ which results in a low going signal on line k. The effect of this low going signal is to advance the ring counter formed by flip-flops $FF_3$ and $FF_4$ just as had been effected in the earlier case by a second actuation of push-button 5. Here, however, the user maintains push-button 5 depressed as long as he wishes the time setting operation to proceed. He releases push-button 5 at approximately the moment when the objective is achieved and the display automatically stops at the next O-crossing.

To restart the display upon receipt of a time signal the user will then actuate once again the push-button and it will be realized that with a high level signal from line h applied to NOR-gate $A_7$ the output on line $g$ will be low level, whereby the output from NAND-gate $A_6$ will be high level, whereby NOR-gate $A_4$ is blocked. Thus the following actuation of switch 5 follows the same sequence as in the example initially described whereby flip-flops $FF_3$ and $FF_4$ are restored to their initial condition and the display proceeds normally.

It will be observed that flip-flops $FF_1$ and $FF_2$ are clocked by the signal $f_4$. Signal $f_4$ has not been illustrated in the timing diagrams of FIGS. 2 and 3, but its frequency will be chosen in order to provide signals as short as possible, but at the same time sufficiently long in duration to suppress the effects of parasitic type of signals generated by actuation of switches 5 or 6 in FIGS. 2 and 3, the waveforms I.M. represent advance pulses applied to the motor by the motor control unit 3 as the unit is alternately set and reset by the pulses $n$ and $f_3$.

What we claim is:

1. An electrically driven timepiece comprising:

time display means including a seconds display means;

a source of timing pulses;

frequency divider means responsive to said timing pulses for producing display advancing pulses;

logic circuit means responsive to said display advancing pulses for controlling application of said display advancing pulses to said seconds display means;

a modulo-three counter having a first stable state for selectively controlling said logic circuit means to apply said display advancing pulses to said seconds display means at a first normal rate, a second stable state for controlling said logic circuit means to apply pulses to said seconds display means at a second faster than normal rate, and a third stable state controlling said logic circuit means to block said display advancing pulses altogether; and, switch means actuable by the user of said timepiece, for advancing said counter in sequence from said first stable state to second to said third and back to said first stable state.

2. An electrically driven timepiece as claimed in claim 1 wherein said modulo-three counter comprises a first and a second bistable device.

3. An electrically driven timepiece as claimed in claim 2 wherein said first and second bistable devices comprise JK flip-flops.

4. An electrically driven timepiece comprising:
display means;
a source of timing pulses;
frequency divider means responsive to said timing pulses for producing display advancing pulses;
logic circuit means responsive to said display advancing pulses for controlling application of said display advancing pulses to said display means;
a ring counter for selectively controlling said logic circuit means to apply said display advancing pulses to said display means at a first normal rate, at a second faster than normal rate, or to block said display advancing pulses altogether;
switch means actuable by the user of said timepiece, for advancing said ring counter;
indexing means associated with said display means for producing an output signal at a predetermined setting of said display means; and,
circuit means responsive to the output signal from said indexing means and a random actuation of said switch means for controlling said ring counter to thereby block said display advancing pulses, whereby the advance of said display is arrested.

5. An electrically driven timepiece as claimed in claim 1 wherein said display means comprises a seconds hand, a minute hand, and an hour hand, and electromechanical means responsive to said display means advancing pulses for driving said hands.

6. An electrically driven timepiece as claimed in claim 4 wherein said display means includes a seconds hand, and said indexing means includes a cam driven synchronously with said seconds hand and a switch operable by said cam once during each revolution of said seconds hand to thereby produce said indexing means output signal.

7. An electrically driven timepiece as claimed in claim 2 wherein said frequency divider means produces a first sequence of pulses at said normal rate and a second sequence of pulses at said faster than normal rate, said logic circuit means comprising:
first gating means responsive to said first bistable device for applying said second sequence of pulses to said display means as long as a first actuation of said switch means is continued; and,
second gating means responsive to said first bistable device for applying said first sequence of pulses to said display means upon a second actuation of said switch means;
and means responsive to said second bistable device for blocking both said sequences of pulses during the interval between the termination of said first actuation and the beginning of said second actuation of said switch means to thereby arrest the advance of said display means at a predetermined setting thereof.

8. An electrically driven timepiece as claimed in claim 7 wherein said predetermined setting corresponds to the zero setting of a seconds display.

9. An electrically driven timepiece comprising:
display means;
a position sensing means associated with said display means;
a source of pulses for advancing said display means and said position sensing means;
a manually operated switch;
circuit means responsive to a random actuation of said manually operated switch and a subsequent actuation of said position sensing means for blocking application of said pulses to said display means when said position sensing means is actuated.
whereby advance of said display means is stopped at a predetermined position in response to a random actuation of said manually operated switch.

10. An electrically driven timepiece as claimed in claim 9 wherein said circuit means controls said advancing pulses to advance said display means at a first rate prior to actuation of said manually operated switch, and at a second faster rate from the time said manually operated switch is actuated until said position sensing means is actuated.

* * * * *